US006964505B2

(12) United States Patent
Wu et al.

(10) Patent No.: US 6,964,505 B2
(45) Date of Patent: Nov. 15, 2005

(54) EASILY ASSEMBLED LAMP ASSEMBLING DEVICE

(75) Inventors: Wen-Chang Wu, Chang Hua Hsien (TW); Jeffrey F. Jacumin, Connelly Springs, NC (US); Brian J. Severson, Statesville, NC (US)

(73) Assignee: Lowe's Companies, Inc., Wilkesboro, NC (US)

( * ) Notice: Subject to any disclaimer, the term of this patent is extended or adjusted under 35 U.S.C. 154(b) by 0 days.

(21) Appl. No.: 10/192,797

(22) Filed: Jul. 11, 2002

(65) Prior Publication Data

US 2004/0008518 A1 Jan. 15, 2004

(51) Int. Cl.[7] ..... F21S 8/06

(52) U.S. Cl. ..... 362/404; 362/147; 362/430; 362/457

(58) Field of Search ..... 362/147, 404, 362/407, 428, 430, 437, 457

(56) References Cited

U.S. PATENT DOCUMENTS

| | | | | |
|---|---|---|---|---|
| 1,453,233 | A | | 4/1923 | Ball, Jr. |
| 1,901,235 | A | | 3/1933 | Glowacki |
| 2,285,883 | A | | 6/1942 | Anderson |
| 2,448,001 | A | | 8/1948 | Maurette |
| 2,507,308 | A | | 5/1950 | Kruger |
| 2,509,895 | A | | 5/1950 | Wakefield |
| 2,711,876 | A | | 6/1955 | Goebel |
| 2,967,040 | A | | 1/1961 | Picha |
| 2,990,153 | A | | 6/1961 | Wolar |
| 3,041,035 | A | | 6/1962 | Pascucci |
| 3,302,918 | A | | 2/1967 | Cohen |
| 3,378,221 | A | | 4/1968 | Wolar et al. |
| 3,620,376 | A | | 11/1971 | Gingher |
| 3,736,417 | A | | 5/1973 | Williams |
| 4,041,657 | A | | 8/1977 | Schuplin |
| 4,064,427 | A | * | 12/1977 | Hansen et al. ..... 362/96 |
| 4,303,968 | A | * | 12/1981 | Goralnik ..... 362/147 |
| 4,695,114 | A | | 9/1987 | Stanton et al. |
| 4,700,917 | A | | 10/1987 | Dillman |
| 4,788,383 | A | | 11/1988 | Caison |
| 4,864,941 | A | | 9/1989 | Goulter |
| 4,934,644 | A | | 6/1990 | Nagy et al. |
| 4,980,808 | A | | 12/1990 | Lilos |
| 5,484,076 | A | | 1/1996 | Petrushka |
| 5,546,724 | A | | 8/1996 | Reinklou |
| 6,036,154 | A | | 3/2000 | Pearce |

FOREIGN PATENT DOCUMENTS

| | | |
|---|---|---|
| JP | 05 094710 A | 4/1993 |
| JP | 08 298014 A | 11/1996 |
| JP | 11 283430 A | 10/1999 |

* cited by examiner

*Primary Examiner*—John Anthony Ward
(74) *Attorney, Agent, or Firm*—Alston & Bird LLP

(57) ABSTRACT

An easily assembled lamp assembling device comprising a supporting frame installed on a light steel frame and a base locking to the supporting frame by screws. Two sides of the supporting frame have respective shrouds. The supporting frame has a buckling hole. The buckling hole extends to the shroud. An open space is formed above the buckling hole. The suspending screw rod is buckled to the opening space. The confining plate is exactly buckled to the buckling hole. Thereby, the suspending screw rod exactly protrudes from the supporting frame. A protruding end of the suspending screw rod exactly passes through a via hole in the base. A lock nut engages the suspending screw rod so that the base is substantially positioned to the supporting frame. A lamp is fixed to a lower side of the though hole. Thereby, an easy assembly lamp is formed.

19 Claims, 6 Drawing Sheets

EASILY ASSEMBLED LAMP ASSEMBLING DEVICE

BACKGROUND OF THE INVENTION

The present invention relates to lamp assembled devices, and particularly to an easily assembled lamp assembling device.

Referring to FIG. 1, a prior art assembling device of a lamp is illustrated. In assembling a stand lamp, or a seat lamp, or a wall lamp or a ceiling lamp, a light steel frame N is used to lock a top of the lamp. A switch box 3 is locked thereto. A lower end of the switch box 3 is installed with a supporting plate 5 by studs P2. A center of the supporting plate 5 is locked with a stud 6. A lower end of the stud 6 is coupled to a portion of a base 2. A sleeve 22 is used to engage the stud with the base 2. Since in this prior art structure, the stud 6 is directly locked to the lower end of the light steel frame N. The assembly steps must be executed one by one. The base 2 can not assembled in advance. Thereby, the assembly work is complicated and cost in manufacturing process is high.

SUMMARY OF THE INVENTION

Accordingly, the primary object of the present invention is to provide an easily assembled lamp assembling device comprising a supporting frame installed on a lower end of a light steel frame and a base locking to the supporting frame by screws. Two sides of the supporting frame have respective shrouds. The lower end of the supporting frame has a buckling hole. The buckling hole extends to the shroud. An open space is formed above the buckling hole. The open space has a tapered shape with a larger upper side. A suspending screw rod has a top buckled with a confining plate. The suspending screw rod is buckled to the opening space. The confining plate is exactly buckled to the buckling hole of the supporting frame. Thereby, the suspending screw rod exactly protrudes from a lower end of the supporting frame. A center of the base has a via hole. A protruding end of the suspending screw rod exactly passes through the via hole. A locking nut engages the suspending screw rod so that the base is substantially positioned to the lower end of the supporting frame. A lower end of the base is formed with a though hole. A lamp is fixed to a lower side of the though hole. Thereby, an easy assembly lamp is formed.

The various objects and advantages of the present invention will be more readily understood from the following detailed description when read in conjunction with the appended drawing.

DETAILED DESCRIPTION OF THE PREFERRED EMBODIMENTS

Figure 1:
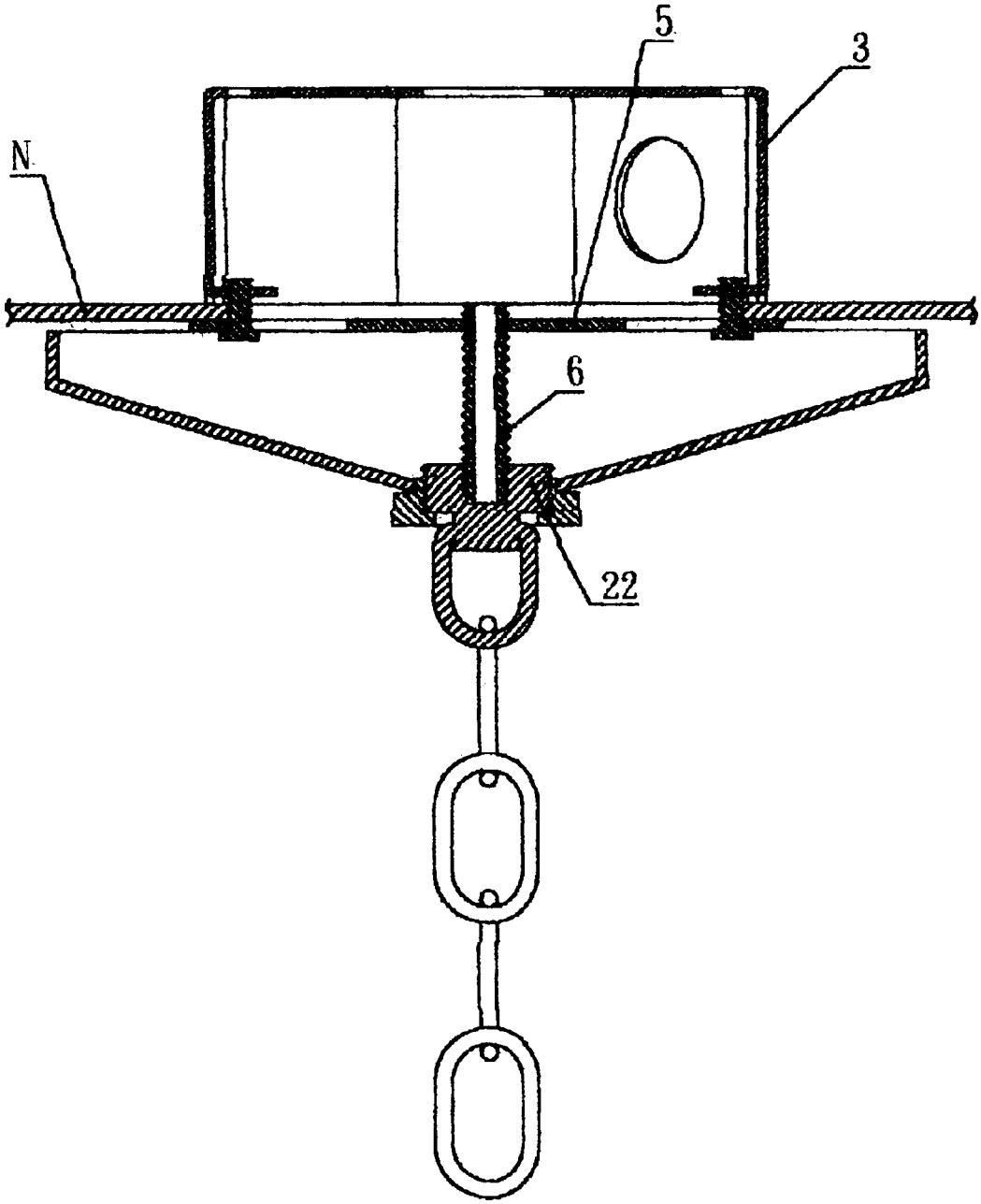
FIG. 1 is a cross sectional view of a prior art design.
Figure 2:
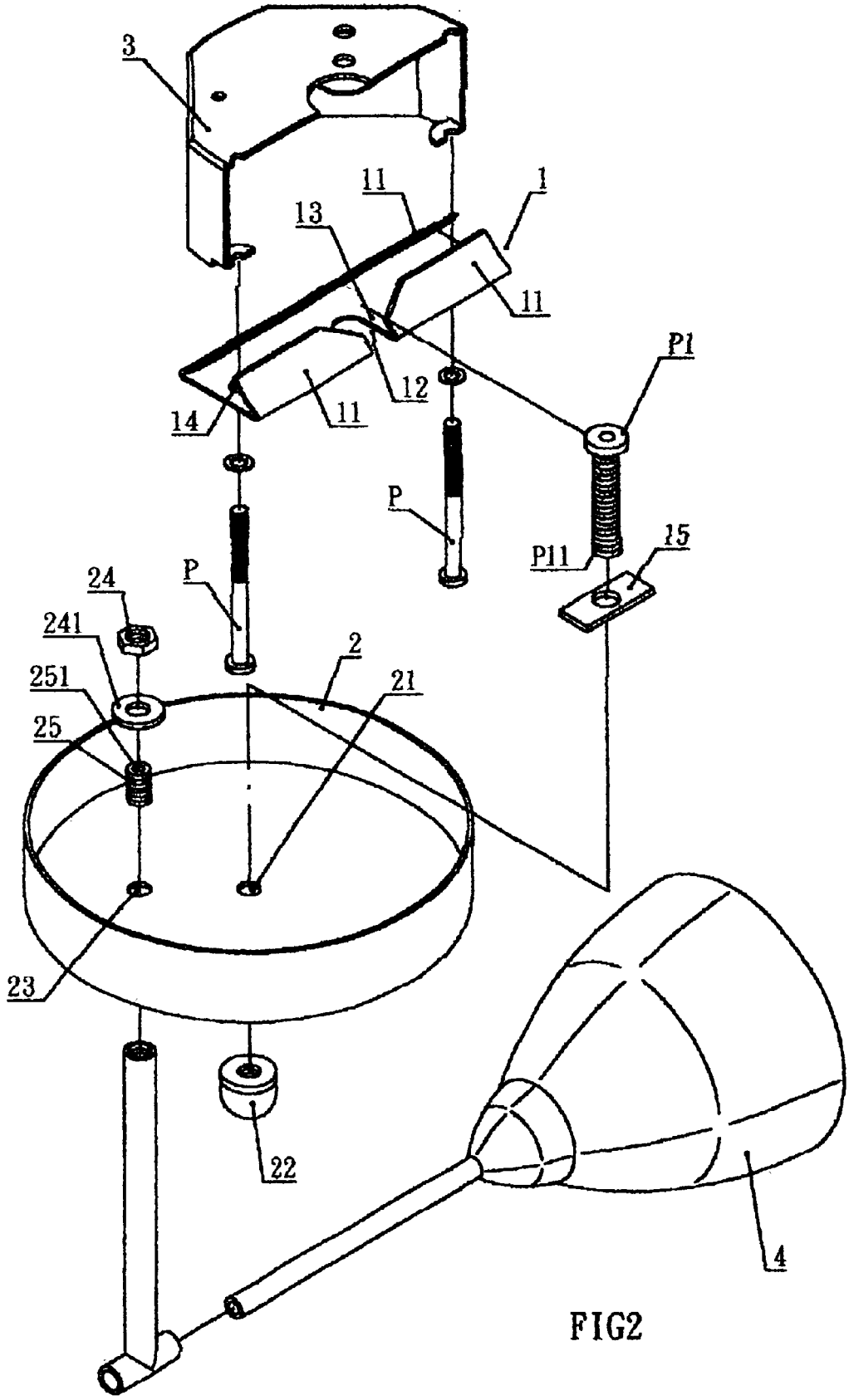
FIG. 2 is an exploded perspective view of the present invention.
Figure 3:
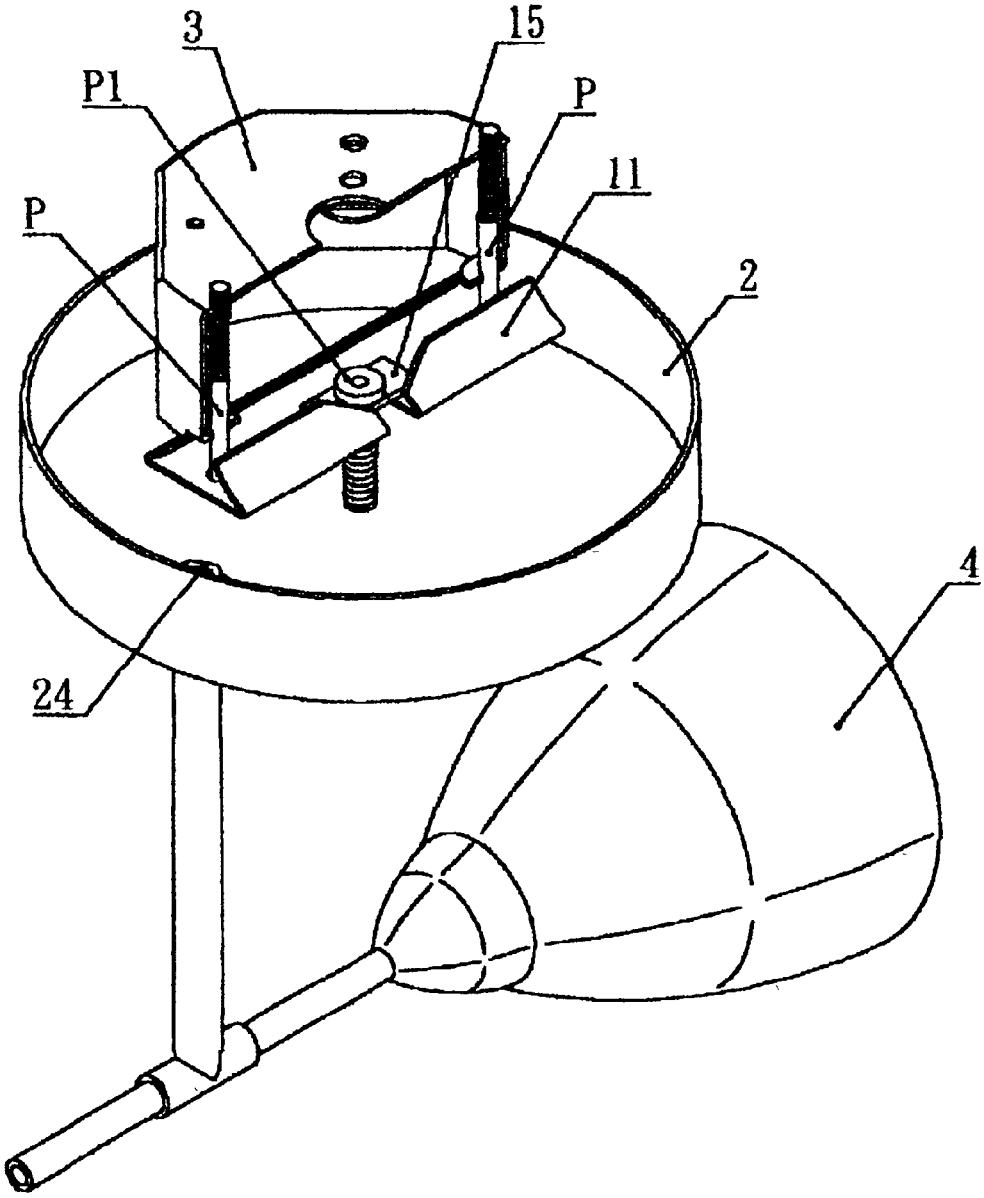
FIG. 3 is an assembled perspective view of the present invention.

Referring to FIGS. 2 and 3, the structure of the present invention is illustrated. The present invention is mainly formed by a supporting frame 1 installed on a lower end of a light steel frame and a base 2 buckled under the supporting frame 1 by a stud P.

The portion of the light steel frame N locking a ceiling lamp has an opening N1 exactly inserted by a switch box 3 of the ceiling lamp. Thereby, the switch box 3 can be locked to the light steel frame N.

Two sides of the supporting frame 1 have respective shrouds 11 which are bent upwards. A lower end of the supporting frame 1 has a buckling hole 12. One end of the buckling hole 12 extends to the shroud 11. An open space 13 is formed above the buckling hole 12. The open space 13 has a tapered shape with a larger upper side. Two sides of the bottom of the supporting frame 1 are installed with respective locking holes 14. Studs P can pass through the locking holes 14 so that the supporting frame 1 is locked to the lower end of the light steel frame N. A suspending screw rod P1 has a top buckled with a confining plate 15. The suspending screw rod P1 is buckled to the opening space 13 of the supporting frame 1. The confining plate 15 is exactly buckled to an upper side of the buckling hole 12 of the supporting frame 1. Thereby, the suspending screw rod P1 exactly protrudes from a lower end of the supporting frame 1 so as to lock the base 2.

A center of the base 2 has a via hole 21. The protruding end P11 of the suspending screw rod P1 exactly passes through the via hole 21. A lock nut 22 engages the lower end of the suspending screw rod P1 so that the base 2 is substantially positioned to the lower end of the supporting frame 1. A lower end of the base 2 is formed with a though hole 23. An upper side of the though hole 23 is locked with a stud 25 lock to the nut 24 through a washer 241. In that, the lower end of the stud 25 protrudes from the lower end of the base 2 so that the lamp 4 can be locked to this end. A center of the stud 25 has a receiving hole 251 for passing the electric wire so that electric wires S suspending from the light steel frame N can be bent and then extend to the interior of the lamp 4 from the receiving hole 251 of the stud 25.

Figure 4:
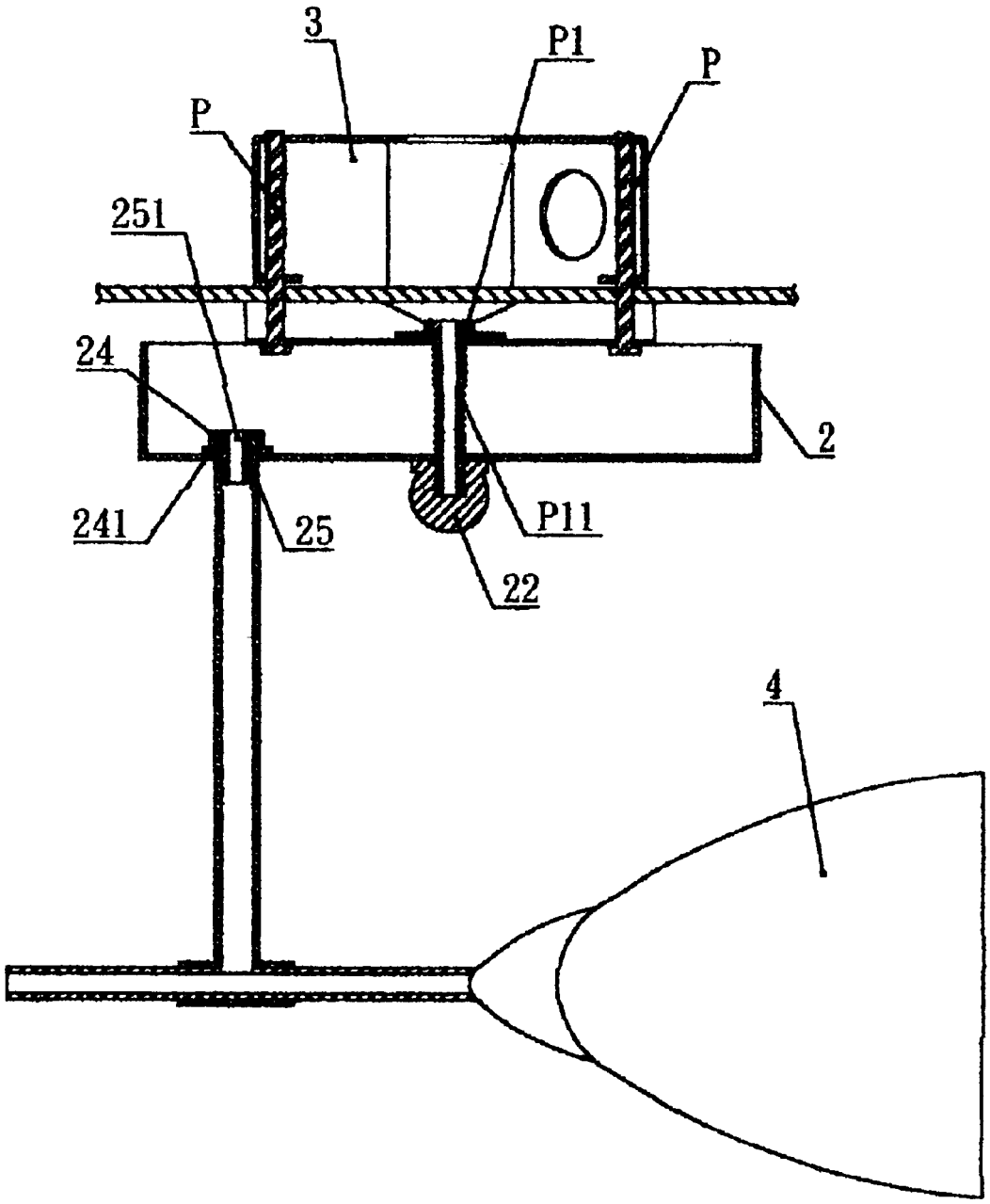
FIG. 4 is an assembled plane view of the present invention.

Referring to FIG. 4, by forming a buckling hole 12 at a lower end of the supporting frame 1 and one end of the buckling hole 12 extends to the shroud 11 of the supporting frame 1. An open space 13 is formed on the shroud 11, and the open space 13 has a tapered shape with a large upper opening. A suspending screw rod P1 with a top buckling to a confining plate 15 is embedded into a notch at the top side of the open space 13. Thereby, the nut 22 can lock the base 2 to the suspending screw rod P1. Then suspending screw rod P1 passes through the open space 13 of the supporting frame 1 so that the lamp 4 at the lower end of the base 2 is firmly secured to the lower end of the light steel frame N without needing other locking tools. The assembly work can be executed easily.

Figure 5:
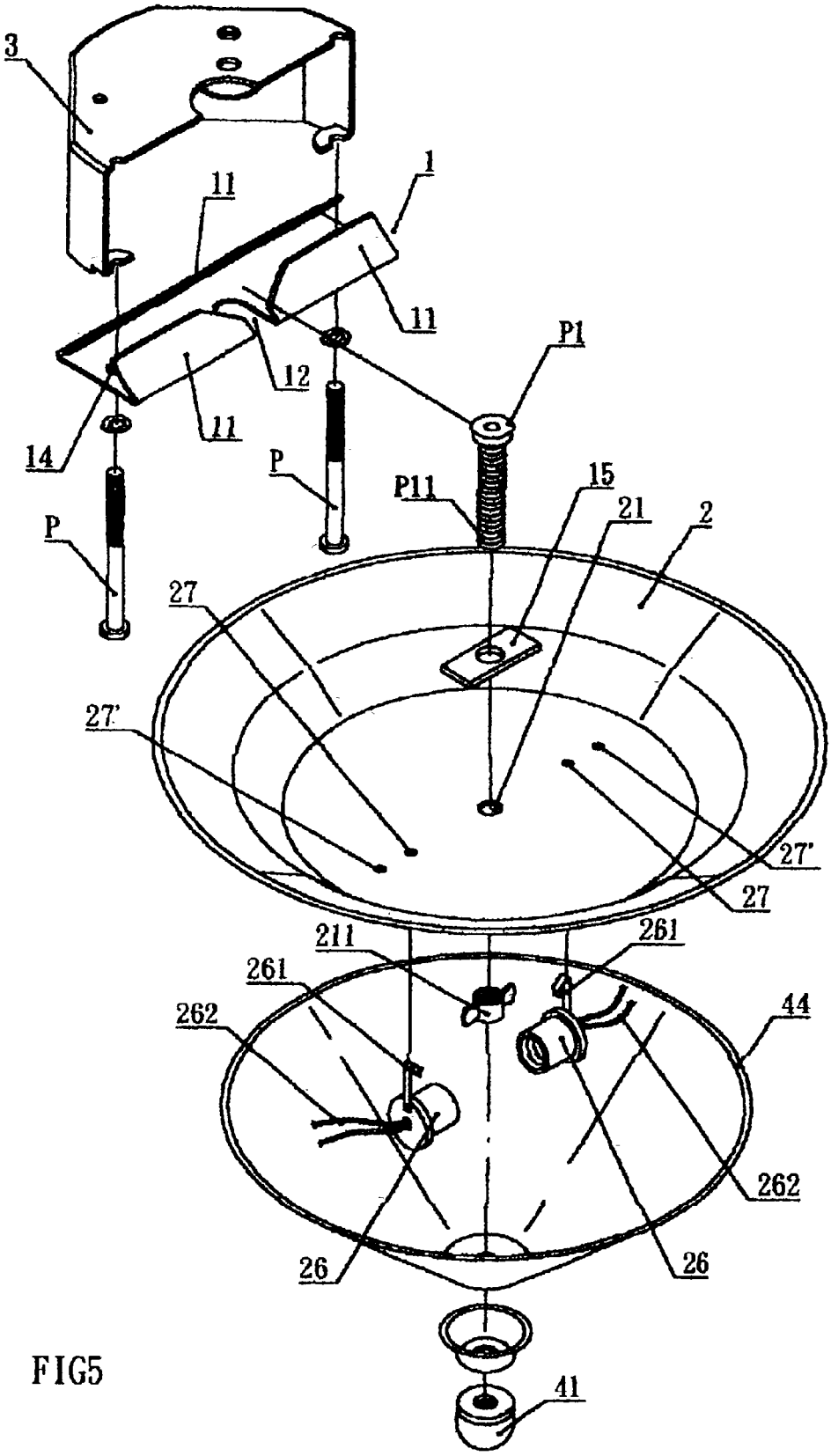
FIG. 5 shows another embodiment of the present invention.

Referring to FIG. 5, another embodiment of the present invention is illustrated. Two sides of the base 2 have pass holes 27, 27' for buckling the hooks 261 of the lamp seat 26 at the lower side of the base 2. The electric wires 262 of the lamp seat 26 protrude out of the pass holes 27' to be electrically connected to the switch box 3 on the light steel frame N. A lower end of the via hole 21 of the base 2 is screwedly installed to the lower end of the suspending screw rod P1 so as to position the base 2 to the lower end of the light steel frame N. A nut 41 at the lower side of the base 2 serves to lock a lampshade 4A so as to hide the lamp seat 26 and a disk-like nut 21 in the lampshade 4A.

Figure 6:
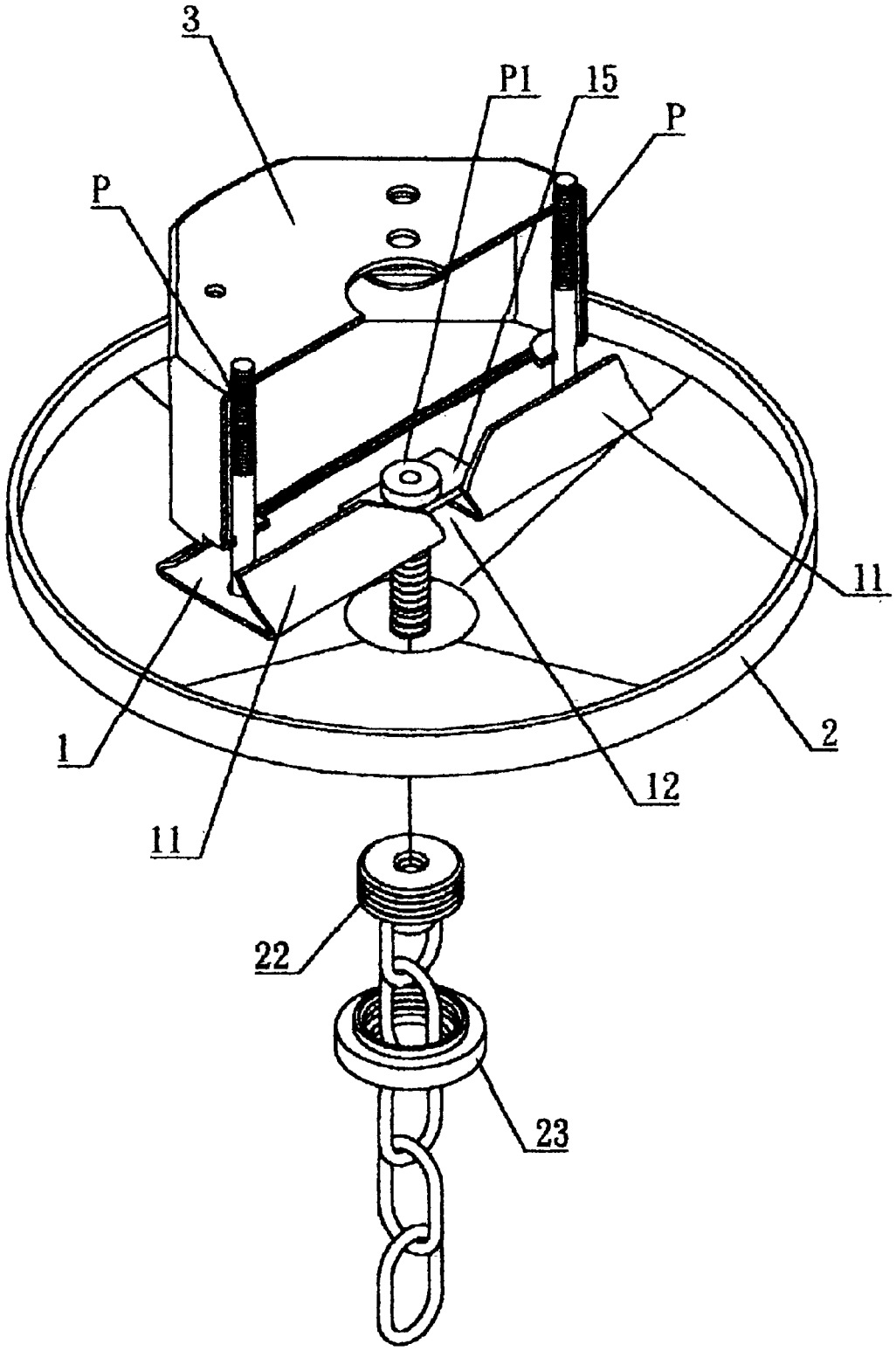
FIG. 6 shows a further embodiment of the present invention.

With reference to FIG. 6, a third embodiment of embodiment is illustrated. A center of the base 2 has a via hole 21.

A suspending screw rod P1 exactly passes through the via hole 21 with a protruding end P11 exposed from a via hole 21. A circular sleeve 28 is engaged at a lower end of the suspending screw rod P1 to be lock at a portion of the suspending screw rod P1 which is coupled to the base 2. A locking nut 29 locks the lower section of the sleeve. Thereby, the suspending screw rod P1 passes through the notch on the open space 13 of the supporting frame 1 so as to lock the base 2 without using any tool.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An easily assembled lamp assembling device for attachment to a frame, the device comprising:

a lamp;

a suspending screw rod having first and seconds ends, said first end of said suspending screw rod being connected to said lamp;

a supporting frame structure to be mounted to the frame, said supporting frame having a lower end and first and second sides, said first side of said supporting frame defining first and second shrouds extending away from said lower end of said supporting frame so as to define an acute angle between said first and second shrouds and said lower end of said supporting frame, said lower end of said supporting frame defining a buckling hole extending to said first and second shrouds, said first and second shrouds defining an open space therebetween; and wherein said open space defined by said first and second shrouds and said buckling hole defined by said lower end of said supporting frame are structured such that said suspending screw rod can pass through at least a portion of said open space and buckling hole, and wherein said lower end of said supporting frame adjacent said buckling hole in structured to support said second end of said suspending screw rod so that said lamp may be mounted to, and demounted from, said supporting frame.

2. A device as recited in claim 1 wherein said open space has a tapered configuration.

3. A device as recited in claim 1 wherein said open space is positioned above at least a portion of said buckling hole.

4. A device as recited in claim 1 wherein said lamp comprises a base, said base defining a via hole structured to receive said first end of said suspending screw rod.

5. A device as recited in claim 1 wherein said second end of said suspending screw rod comprises a confining plate.

6. A device as recited in claim 1 wherein said lamp comprised wiring, and wherein said suspending screw rod defines a receiving hole structured to receive said wiring.

7. A device as recited in claim 1 wherein said second side of said supporting frame defines a third shroud extending away from said lower end of said supporting frame so as to define an acute angle between said third shroud and said lower end of said supporting frame.

8. An easily assembled lamp assembling device for attachment to a frame, the device comprising:

a lamp;

a suspending screw rod having first and seconds ends, said first end of said suspending screw rod being connected to said lamp;

a supporting frame structure to be mounted to the frame, said supporting frame having a lower end and first and second sides, said first side of said supporting frame defining first and second shrouds extending away from said lower end of said supporting frame so as to define an acute angle between said first and second shrouds and said lower end of said supporting frame, said second side of said supporting frame defines a third shroud extending away from said lower end of said supporting frame so as to define an acute angle between said third shroud and said lower end of said supporting frame, said lower end of said supporting frame defining a buckling hole extending to said first and second shrouds, said first and second shroud defining an open space therebetween; and wherein said open space defined by said first and second shrouds and said buckling hole defined by said lower end of said supporting frame are structured such that said suspending screw rod can pass through at least a portion of said open space and buckling hole, and wherein said lower end of said supporting frame adjacent said buckling hole in structured to support said second end of said suspending screw rod so that said lamp may be mounted to, and demounted from, said supporting frame.

9. A device as recited in claim 8 wherein said open space has a tapered configuration.

10. A device as recited in claim 8 wherein said open space is positioned above at least a portion of said buckling hole.

11. A device as recited in claim 8 wherein said lamp comprises a base, said base defining a via hole structured to receive said first end of said suspending screw rod.

12. A device as recited in claim 8 wherein said second end of said suspending screw rod comprises a confining plate.

13. A device as recited in claim 8 wherein said lamp comprises wiring, and wherein said suspending screw rod defines a receiving hole structured to receive said wiring.

14. A method of attaching a ceiling lamp to a frame, comprising:

attaching a supporting frame to the frame, the supporting frame comprising a lower end and first and second sides, the first side of the supporting frame defining first and second shrouds extending away from the lower end of the supporting frame so as to define an acute angle between the first and second shrouds and the lower end of the supporting frame, the lower end of the supporting frame defining a buckling hole extending to the first and second shrouds, the first and second shrouds defining an open space therebetween;

arraching a first end of a suspending screw rod to a ceiling lamp;

moving the suspending screw rod through at least a portion of the open space defined by the first and second shrouds and the buckling hole defined by the lower end of the supporting frame; and subsequent to said moving step, mounting a second end of the suspending screw rod on the lower end of the supporting frame to thereby mount the ceiling lamp to the supporting frame.

15. A method according to claim 14 further comprising inserting wiring of the ceiling lamp through a receiving hole defined by the suspending screw rod.

16. A method according to claim 15 further comprising connecting the wiring from the ceiling lamp to wiring at the supporting frame.

17. A method according to claim 14 further comprising moving the suspending screw rod through the buckling hole defined by the lower end of the supporting frame and at least a portion of the open space defined by the first and second shrouds so that the ceiling lamp is demounted from the supporting frame.

18. A method according to claim 14 further comprising attaching a confining plate on the second end of the suspending screw rod.

19. A method according to claim 18 wherein said moving step comprises moving the confining plate through the open space defined by the first and second shrouds.

* * * * *